US005240173A

United States Patent [19]

Dagostine

[11] Patent Number: 5,240,173

[45] Date of Patent: Aug. 31, 1993

[54] PRODUCT SLEEVE HAVING PREMIUM CARD FORMED INTEGRALLY THEREWITH

[75] Inventor: Leslie J. Dagostine, Dollard des Ormeaux, Canada

[73] Assignee: Somerville POackaging, Division of Paperboard Industries Corporation, Toronto, Canada

[21] Appl. No.: 997,170

[22] Filed: Dec. 28, 1992

[51] Int. Cl.[5] ..... B65D 5/02

[52] U.S. Cl. ..... 229/40; 206/427; 206/831; 493/84; 493/128; 493/162

[58] Field of Search ..... 206/427, 831, 459.5; 229/40, 118; 40/312; 493/84, 128, 130, 162

[56] References Cited

U.S. PATENT DOCUMENTS

| | | | |
|---|---|---|---|
| 3,183,614 | 5/1965 | Loderhose | 206/831 |
| 3,469,765 | 9/1969 | Mueller | 493/162 |
| 3,625,412 | 12/1971 | Rosenburg, Jr. | 206/831 |
| 4,000,814 | 1/1977 | Stout | 206/831 |
| 4,005,644 | 2/1977 | Tranquillitsky | 493/128 |
| 4,103,820 | 8/1978 | Mathison et al. | 206/831 |
| 4,197,984 | 4/1980 | Hartman et al. | 206/831 |
| 4,314,634 | 2/1982 | Stove | 206/427 |
| 4,403,689 | 9/1983 | Wood | 206/831 |
| 4,834,240 | 5/1989 | Dagostine | 206/831 |

FOREIGN PATENT DOCUMENTS

| | | | |
|---|---|---|---|
| 682281 | 3/1964 | Canada . | |
| 430013 | 6/1991 | European Pat. Off. | 206/831 |

*Primary Examiner*—Gary E. Elkins

[57] ABSTRACT

A product sleeve blank comprises a number of panels hingedly connected together. The outside panels have interengagement structure associated therewith. One of the outside panels has a premium card detachably joined to an edge thereof along a perforation line. The sleeve blank is sized so that when this outside panel is folded about its hinge line with the adjacent panel, the premium card overlies a further panel between the hinge lines of that panel. The premium card may be affixed to this further panel and then the premium card detached from the outside panel with which it is associated so that the panels may be hinged and the interengagement structure engaged to form a sleeve. The premium card may be readily removed by a consumer by being peeled from the panel to which it is affixed.

10 Claims, 8 Drawing Sheets

PRODUCT SLEEVE HAVING PREMIUM CARD FORMED INTEGRALLY THEREWITH

BACKGROUND OF THE INVENTION

1. Field of the Invention

This invention relates a product sleeve blank and a method for forming a product sleeve from a product sleeve blank.

2. Description of the Related Art

It is often desired to incorporate coupons, games, or other premiums along with a product for marketing reasons. In a product wrapped with a sleeve, such as wrapped pudding cups, it is known to print coupons directly on the inside surface of the sleeve. A consumer may then employ the coupon by cutting it from the sleeve. This approach has the drawback that it requires considerable consumer effort in order to obtain a desired coupon.

This invention seeks to overcome drawbacks of known product sleeves.

SUMMARY OF THE INVENTION

According to the present invention, there is provided a product sleeve blank comprising: a first outside panel portion having engagement means; a first intermediate panel hingedly connected between said first panel portion and a medial panel; a second intermediate panel hingedly connected between said medial panel and a second outside panel portion, said second outside panel portion having engagement means for engaging with said engagement means of said first outside panel portion; characterised by said second outside panel portion having a premium card detachably joined to an edge thereof which edge is opposite the hinged connection of said second outside panel portion with said second intermediate panel, said second intermediate panel and said second outside panel portion sized so that when said second outside panel portion is hinged about its hinged connection with said second intermediate panel to overlie said second intermediate panel, said premium card overlies said medial panel between the hinged connection of said medial panel with said first intermediate panel and the hinged connection of said medial panel with said second intermediate panel.

According to another aspect of the invention, there is provided a partially assembled product sleeve blank, comprising: a first outside panel portion having engagement means; a first intermediate panel hingedly connected between said first outside panel portion and a medial panel; a second intermediate panel hingedly connected between said medial panel and a second outside panel portion, said second outside panel portion having engagement means for engaging with said engagement means of said first outside panel portion; said second outside panel portion having a premium card detachably joined to an edge thereof which edge is opposite the hinged connection of said second outside panel portion with said second intermediate panel, said second outside panel portion overlieing said second intermediate panel and said premium card overlieing said medial panel between the hinged connection of said medial panel with said first intermediate panel and the hinged connection of said medial panel with said second intermediate panel, said premium card being affixed to said medial panel.

According to a further aspect of the invention, there is provided a method of forming a product sleeve from a product sleeve blank of the type having a first outside panel portion having engagement means; a first intermediate panel hingedly connected between said first outside panel portion and a medial panel; a second intermediate panel hingedly connected between said medial panel and a second outside panel portion, said second outside panel portion having engagement means for engaging with said engagement means of said first outside panel portion and a premium card detachably joined to an edge thereof which edge is opposite the hinged connection of said second outside panel portion with said second intermediate panel, said second intermediate panel and said second outside panel portion sized so that when said second outside panel portion is hinged about its hinged connection with said second intermediate panel to overlie said second intermediate panel, said premium card overlies said medial panel between the hinged connection of said medial panel with said first intermediate panel and the hinged connection of said medial panel with said second intermediate panel, comprising the steps of: depositing glue over an area on the inintermediate surface of said medial panel portion; folding said second outside panel portion with said detachable premium card inwardly about the hinge connection between said second outside panel portion and said second intermediate panel so that said premium card overlies the inner surface of said medial panel and is in contact with said area of glue; when said glue has adhered said detachable premium card to said medial panel, detaching said premium card from said second outside panel portion folding said first and second outside panel portions, said first and second intermediate panels and said medial panel about their respective hinge connections to form a tubular configuration and mating the engagement means of said first outside panel portion with said second outside panel portion to form a product sleeve.

BRIEF DESCRIPTION OF THE DRAWINGS

In the figures which disclose example embodiments of the invention.

DESCRIPTION OF THE PREFERRED EMBODIMENTS

Figure 1:
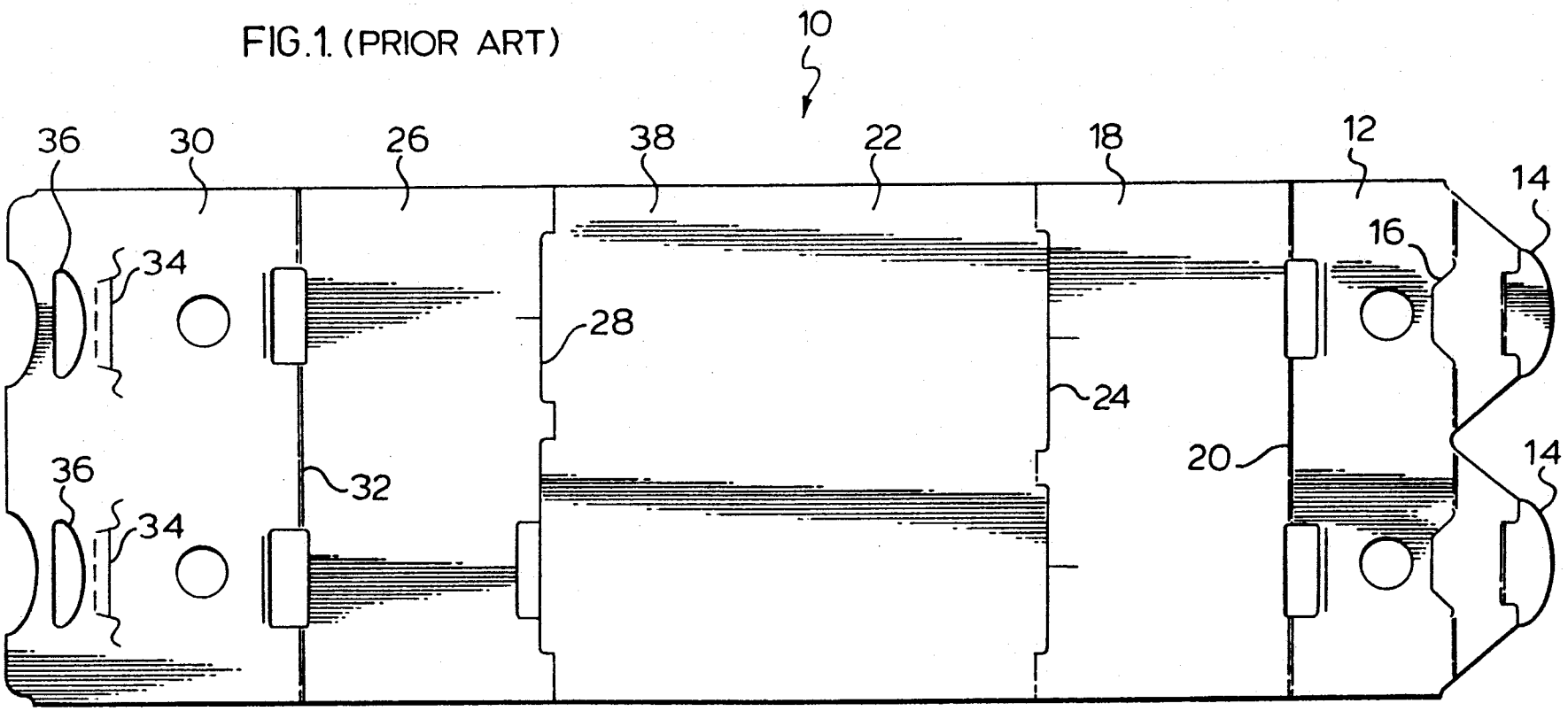
FIG. 1. (PRIOR ART)
FIG. 1 is a plan view of a known product sleeve blank.

With reference to FIG. 1 which shows a known product sleeve for use in wrapping product cups, the sleeve 10 comprises a first outside (bottom) panel portion 12 having engagement means comprising tabs 14 and 16. A first intermediate (side) panel 18 is hinged to the first bottom panel portion 12 along hinge line 20 and is also hingedly connected to a medial (top) panel 22 along hinge line 24. A second intermediate (side) panel 26 is hingedly connected to the top panel 22 at hinge line 28 and a second outside (bottom) panel portion 30 at hinge line 32. The second bottom panel portion 30 has engagement means comprising tab receiving slits 34 and tab receiving openings 36. The sleeve blank may be folded about hinge lines 20, 24, 28, and 32 in order to allow tabs 14 to be received by tab receiving slits 34 and tabs 16 to be received by tab receiving openings 36. The sleeve blank 10 is folded such that its inner surface 38 is inwardly facing in the resulting sleeve. As noted in the description of the related art, it is known to print directly onto the inner surface of the sleeve blank in order to provide coupon representations or the like.

Figure 2:
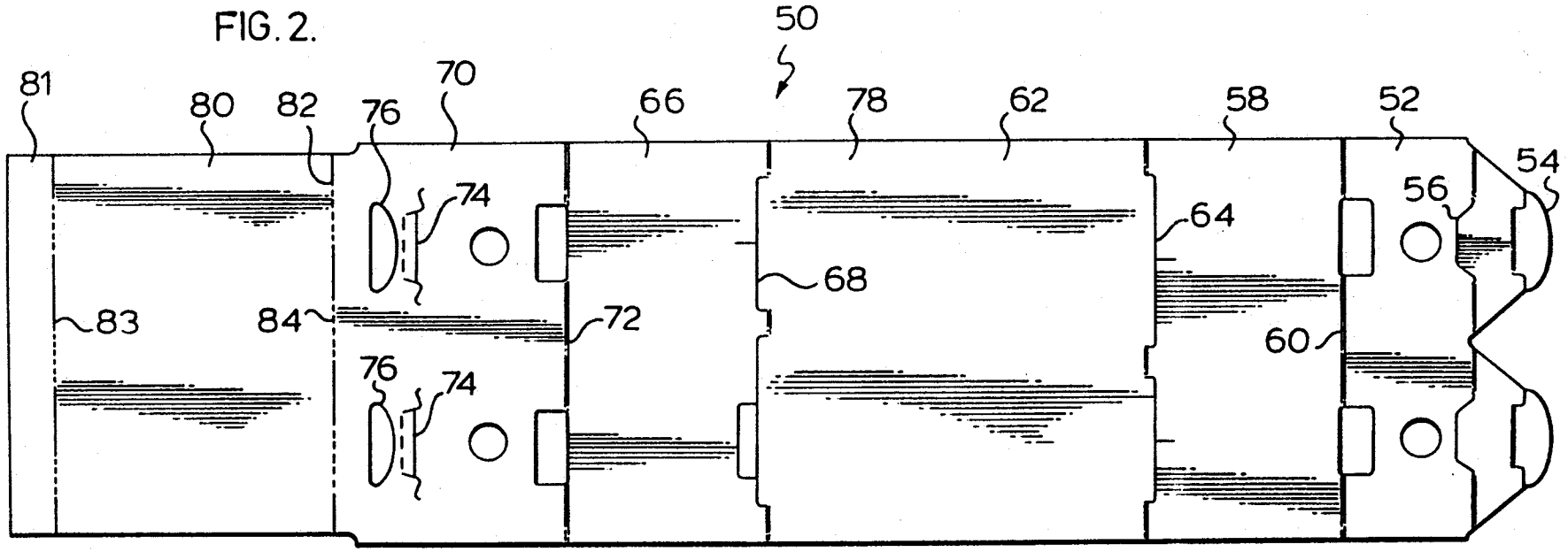
FIG. 2 is a plan view of a product sleeve blank made in accordance with this invention.

Turning to FIG. 2, which illustrates a product sleeve blank 50 made in accordance with this invention, the blank comprises a first outside (bottom) panel portion 52 having engagement means comprising tabs 54 and 56. A first intermediate (side) panel 58 is hingedly connected to the first bottom panel portion 52 along hinge line 60 and is also hingedly connected to a medial (top) panel 62 along hinge line 64. A second intermediat (side) panel 66 is hingedly connected between the top panel 62 and a second outside (bottom) panel portion 70, at hinge lines 68 and 72, respectively. The second bottom panel portion has engagement means comprising tab receiving slits 74 and tab receiving openings 76. The blank has an inner surface 78.

The second bottom panel portion 70 has a premium card 80 detachably joined to edge 82 thereof by perforation line 84. Edge 82 is opposite hinge line 72 of the second bottom panel portion. As seen by reference to FIG. 3, if the second bottom panel portion is folded about hinge line 72 so that the inner surface 78 of the second bottom panel portion 70 overlies the inner surface of the second side panel 66, the premium card 80 overlies top panel 62 between hinge line 64 and 68.

Figure 3:
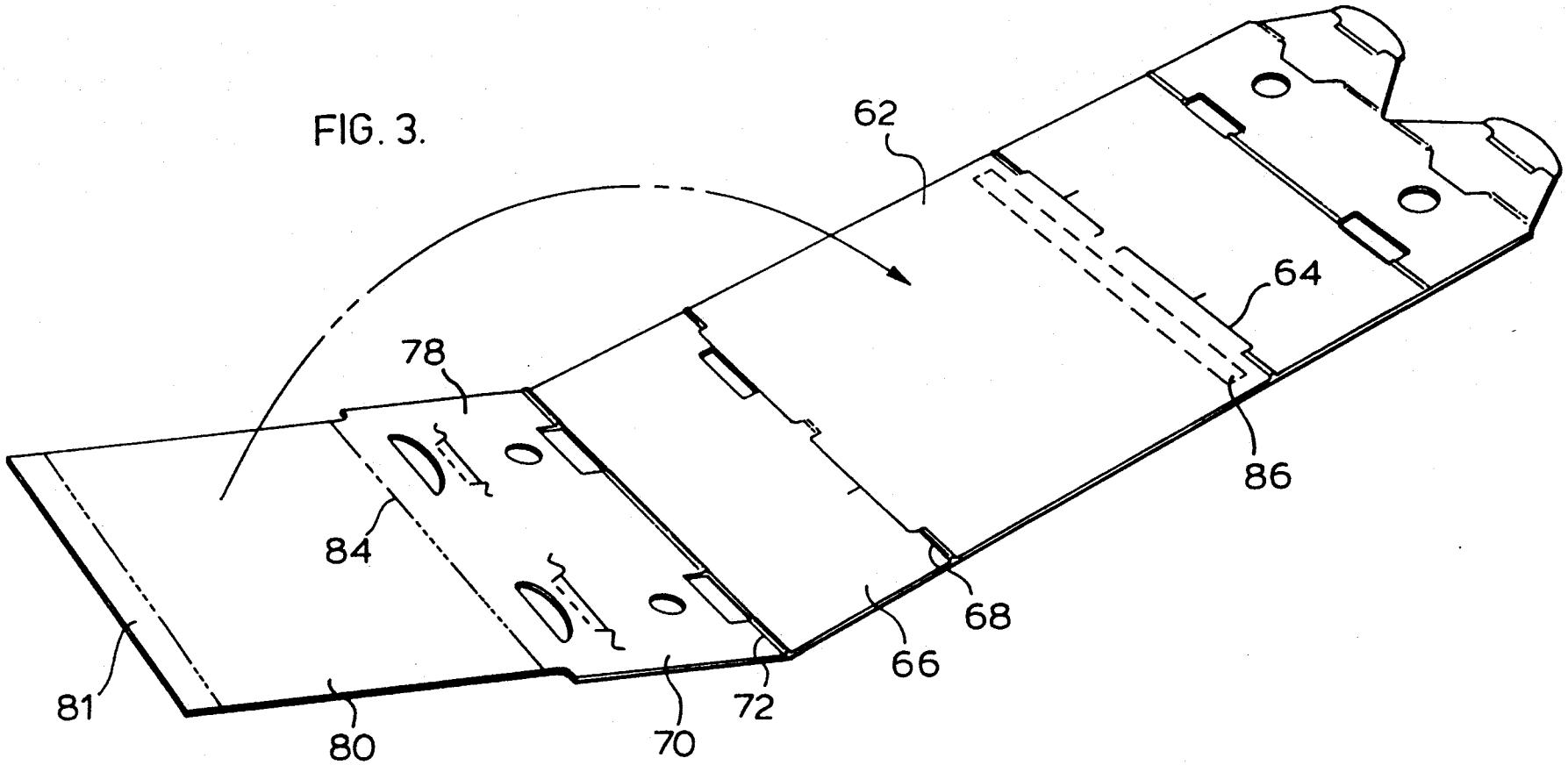
FIG. 3 is a perspective view of the blank of FIG. 2 shown in a partially folded position.
Figure 4:
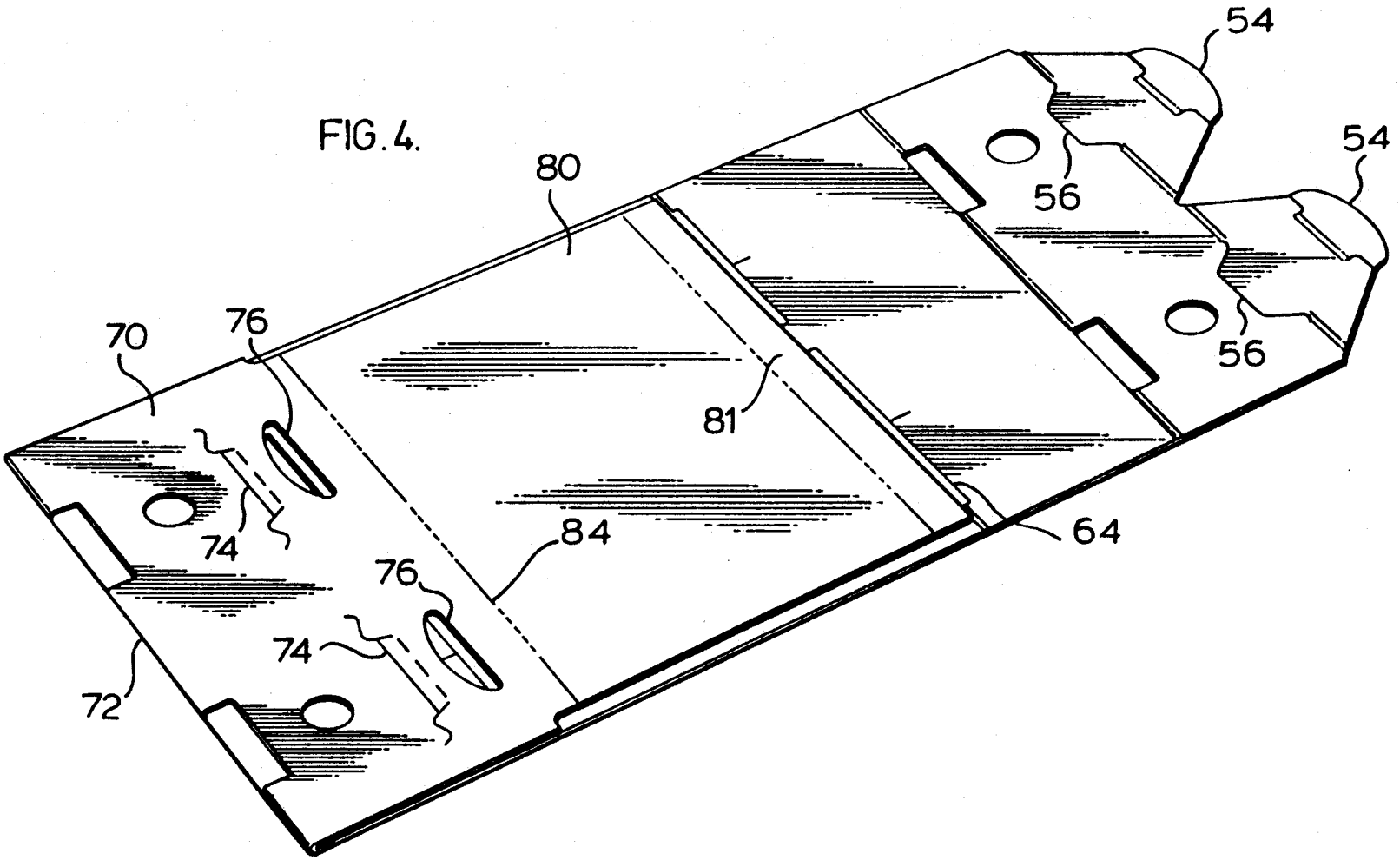
FIG. 4 is a perspective view of the blank of FIG. 2 shown in a partially folded position.

With reference to FIG. 3, the product sleeve blank is formed into a sleeve, as follows. An area of glue is deposited on the inside surface 78 of the top panel 62, as illustrated at 86. The second bottom panel portion 70 is then folded about hinge line 72 inwardly until the premium card 80 overlies the inner surface 78 of the top panel 62 and is brought into contact with the glue area 86, as illustrated in FIG. 4. When the glue has adhered the premium card 80 to the top panel, the premium card is detached from the second bottom panel portion 72 by breaking the perforation line 84. The partially assembled blank may now be folded about hinge lines 60, 64, 68, and 72 in order to allow tabs 54 to be inserted into tab receiving slits 74 and tabs 56 to be received by tab receiving openings 76. It will be apparent that with this arrangement a consumer may, after ripping open the product sleeve, or after removal of product cups therefrom, reach the premium card 80 and readily remove its from the top panel by grasping an edge of the premium card and peeling it from the top panel.

Figure 5:
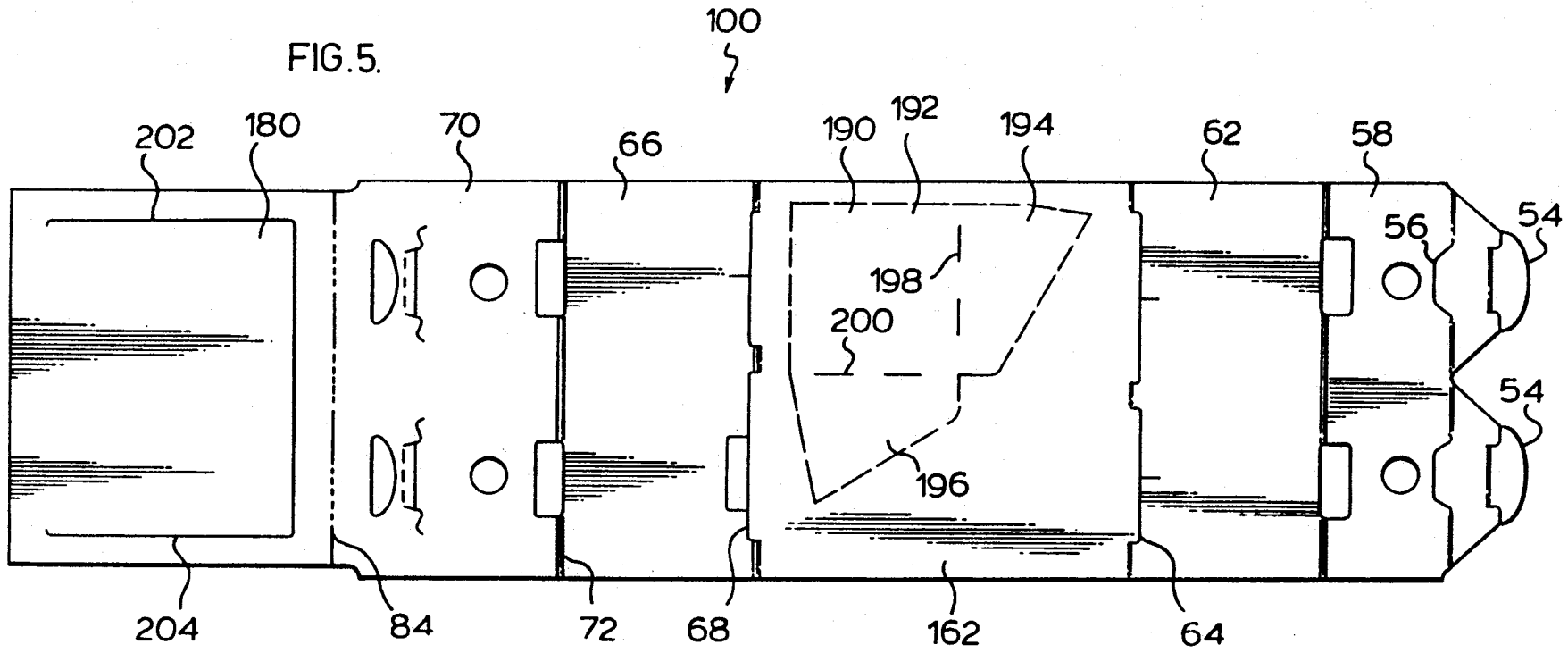
FIG. 5 is a plan view of a product sleeve blank made in accordance with another aspect of this invention.

FIG. 5 illustrates a blank 100 made in accordance with another embodiment of the invention. Turning to FIG. 5 wherein like parts have been given like reference numerals, top panel 162 has a punch-out 190 formed therein. The punch-out has a support section 192 and two wings 194, 196 hingedly connected to the support section along hinge lines, 198, 200, respectively. The premium card 180 has opposed slit lines 202, 204 formed therein. The blank of FIG. 5 permits the forming of a sleeve having a detachable picture frame incorporated therein, as will become more apparent hereinafter.

Figure 6:
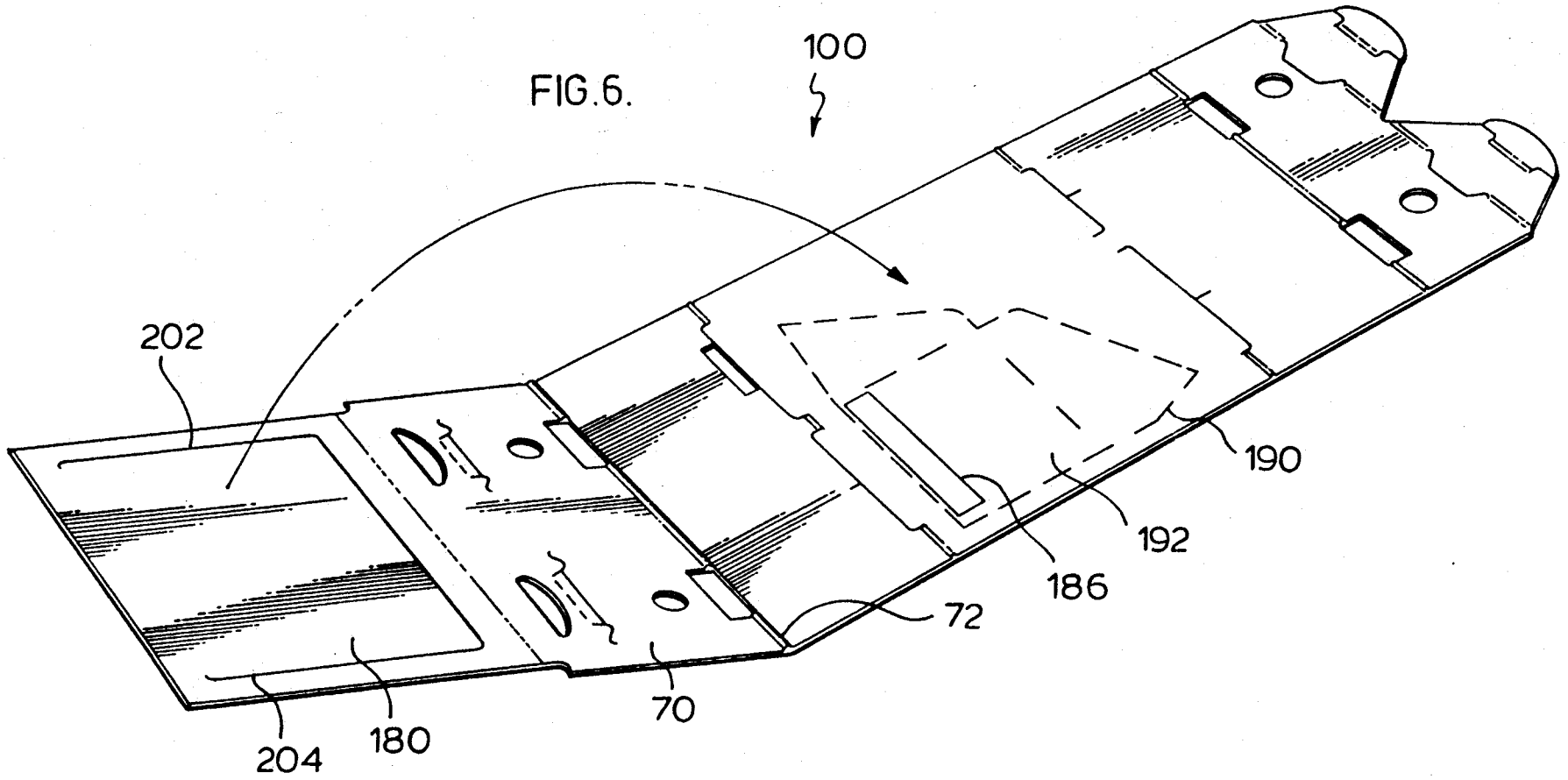
FIG. 6 is a perspective view of the blank of FIG. 5 shown in a partially folded position.
Figure 7:
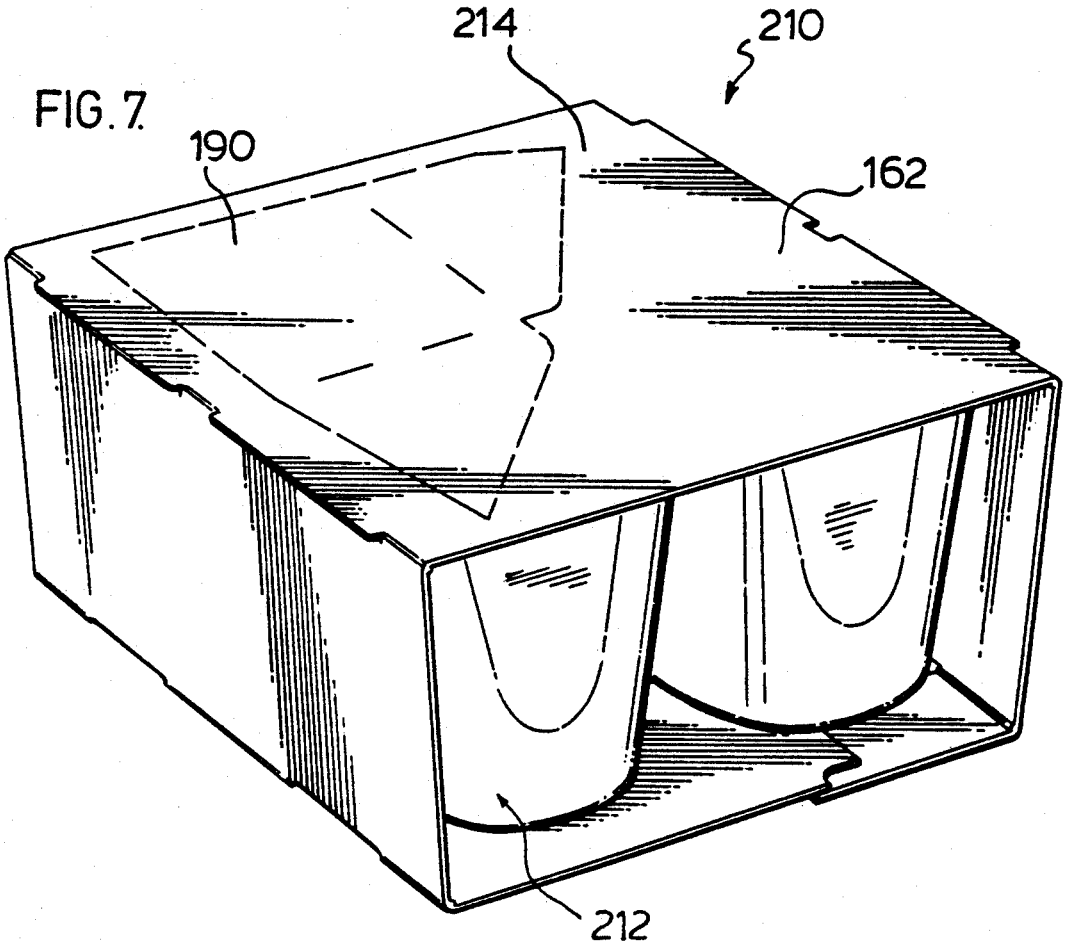
FIG. 7 is a perspective view of a product sleeve formed from the blank of FIG. 5.
Figure 8:
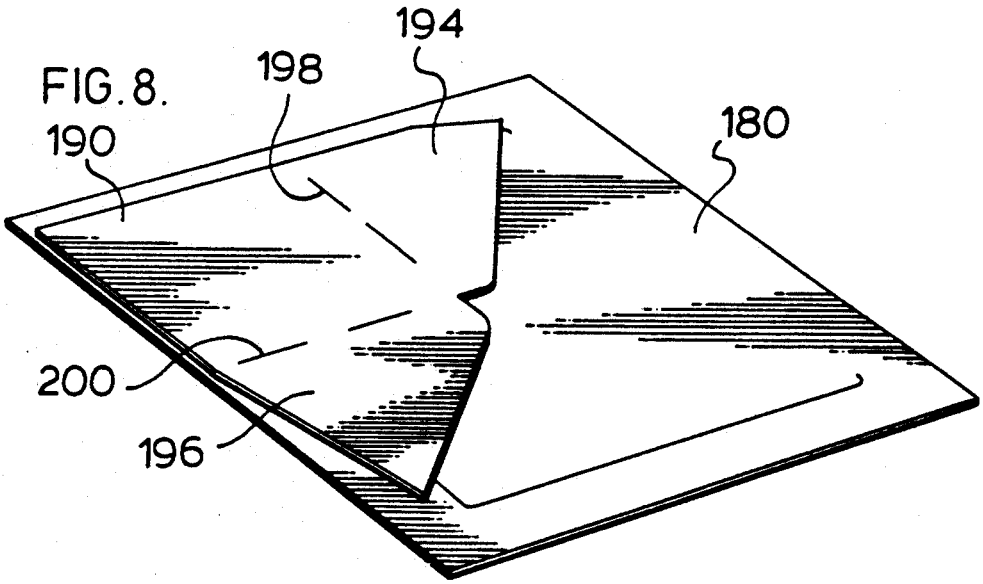
FIG. 8 is a perspective view of a portion of the product sleeve of FIG. 7.

With reference to FIG. 6, the blank of FIG. 5 is assembled into a sleeve by first spreading glue over an area 186 on the support section 192 of the punch-out 190. The second bottom panel portion 70 is then folded about hinge line 72 so that the premium card 180 overlies the top panel and is in contact with this area of glue 186. Once the glue has affixed the premium card to the support section of the punch-out of the top panel, the premium card is detached from the second bottom panel portion 70 and the blank is formed into a sleeve 210, as illustrated in FIG. 7. FIG. 7 shows the sleeve with product cups 212 therein. A consumer, after opening the sleeve 210 or removing the product cups 212, may push the punch-out from the outside surface 214 of the top panel 162 in order to remove the premium card 180 and punch-out 190 from the sleeve. The liberated premium card 180 with punch-out 190 is illustrated in FIG. 8. Thereafter, the consumer may insert the edges of a picture through the slits 202 and 204 of the card so that the picture is supported by the card 180; the consumer may then bend the wings 194 and 196 about hinge lines 198 and 200 in order that the premium card 180 may be propped up by the wings to display the picture.

Figure 9:
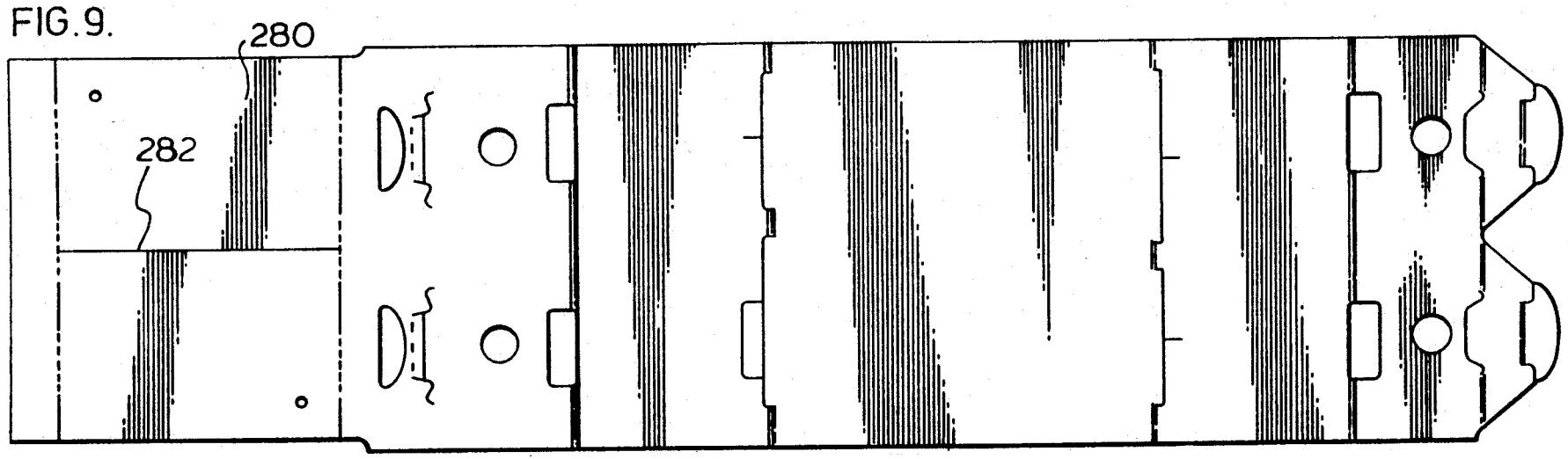
FIG. 9 is a plan view of a product blank made in accordance with another aspect of this invention.
Figure 10:
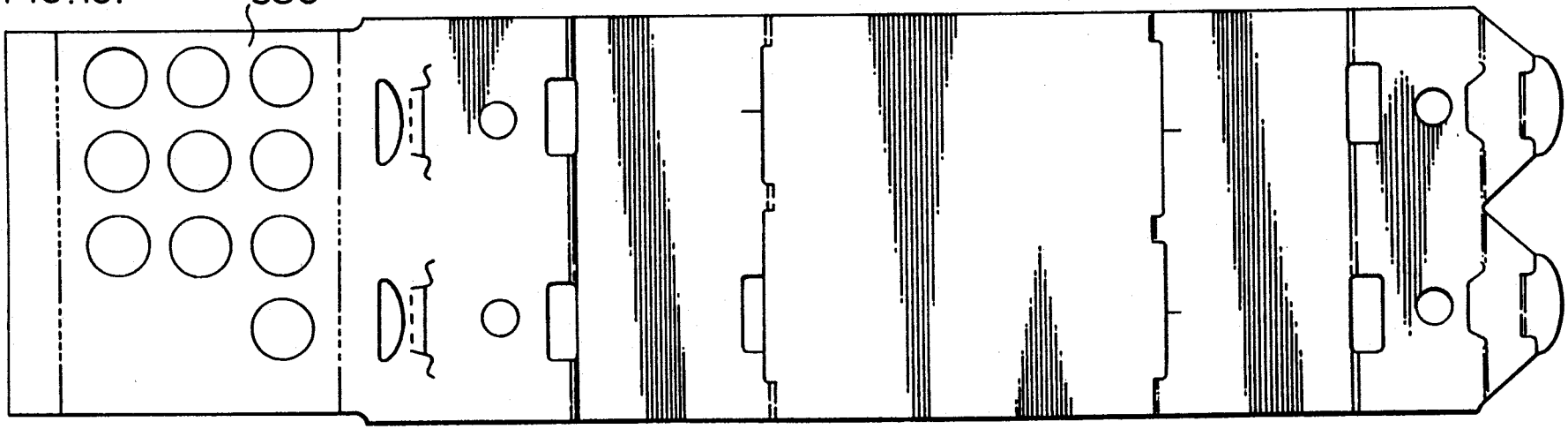
FIG. 10 is a plan view of a product blank made in accordance with another aspect of this invention.

With reference to FIG. 9 wherein like parts have been given like reference numerals, the premium card 280 has a medial score line 282 so that the premium card may be printed up as a greeting card. With reference to FIG. 10 wherein like parts have been given like reference numerals, the premium card 380 has been printed up as a bingo card. Additionally, the premium card be printed as a coupon.

Other modifications will be apparent to those skilled in the art and, accordingly, the invention is defined in the claims.

What is claimed is:

1. A product sleeve blank comprising:

a first outside panel portion having engagement means;

a first intermediate panel hingedly connected between said first outside panel portion and a medial panel;

a second intermediate panel hingedly connected between said medial panel and a second outside panel portion, said second outside panel portion having engagement means for engaging with said engagement means of said first outside panel portion;

characterised by said second outside panel portion having a premium card detachably joined to an edge thereof which edge is opposite the hinged connection of said second outside panel portion with said second intermediate panel, said second intermediate panel and said second outside panel portion sized so that when said second outside panel portion is hinged about its hinged connection with said second intermediate panel to overlie said second intermediate panel, said premium card overlies said medial panel between the hinged connection of said medial panel with said first intermediate panel and the hinged connection of said medial panel with said second intermediate panel.

2. The product sleeve blank of claim 1 wherein said medial panel comprises a punch-out positioned so that, when said second outside panel portion is hinged about its hinged connection with said second intermediate panel to overlie said second intermediate panel, said premium card overlies said punch-out.

3. The product sleeve blank of claim 1 wherein said medial panel comprises a punch-out comprising a support section with at least one wing hingedly connected thereto, said support section positioned so that, when said second outside panel portion is hinged about its hinged connection with said second intermediate panel to overlie said second intermediate panel, said premium card overlies said support section.

4. The product sleeve blank of claim 3 wherein said premium card has two parallel slits running along opposed sides of the premium card.

5. A partially assembled product sleeve blank, comprising:

a first outside panel portion having engagement means;

a first intermediate panel hingedly connected between said first outside panel portion and a medial panel;

a second intermediate panel hingedly connected between said medial panel and a second outside panel portion, said second outside panel portion having engagement means for engaging with said engagement means of said first outside panel portion;

said second outside panel portion having a premium card detachably joined to an edge thereof which edge is opposite the hinged connection of said second outside panel portion with said second intermediate panel, said second outside panel portion overlieing said second intermediate panel and said premium card overlieing said medial panel between the hinged connection of said medial panel with said first intermediate panel and the hinged connection of said medial panel with said second intermediate panel, said premium card being affixed to said medial panel.

6. The partially assembled product sleeve blank of claim 5 wherein said medial panel comprises a punch-out positioned so that said premium card overlies said punch-out.

7. The partially assembled product sleeve blank of claim 5 wherein said medial panel comprises a punch-out comprising a support section with at least one wing hingedly connected thereto, said premium card being affixed to said support section.

8. The product sleeve blank of claim 7 wherein said premium card has two parallel slits running along opposed sides of the premium card.

9. The partially assembled product sleeve blank of claim 5 wherein said blank has an outside surface and an inside surface and said premium card is affixed to said medial panel on the inside surface of said blank.

10. A method of forming a product sleeve from a product sleeve blank of the type having a first outside panel portion having engagement means; a first intermediate panel hingedly connected between said first outside panel portion and a medial panel; a second intermediate panel hingedly connected between said medial panel and a second outside panel portion, said second outside panel portion having engagement means for engaging with said engagement means of said first outside panel portion and a premium card detachably joined to an edge thereof which edge is opposite the hinged connection of said second outside panel portion with said second intermediate panel, said second intermediate panel and said second outside panel portion sized so that when said second outside panel portion is hinged about its hinged connection with said second intermediate panel to overlie said second intermediate panel, said premium card overlies said medial panel between the hinged connection of said medial panel with said first intermediate panel and the hinged connection of said medial panel with said second intermediate panel, comprising the steps of:

depositing glue over an area on the inintermediate surface of said medial panel portion;

folding said second outside panel portion with said detachable premium card inwardly about the hinge connection between said second outside panel portion and said second intermediate panel so that said premium card overlies the inner surface of said medial panel and is in contact with said area of glue;

when said glue has adhered said detachable premium card to said medial panel, detaching said premium card from said second outside panel portion;

folding said first and second outside panel portions, said first and second intermediate panels and said medial panel about their respective hinge connections to form a sleeve configuration and mating the engagement means of said first outside panel portion with said second outside panel portion to form a product sleeve.

* * * * *